United States Patent [19]

Palmer

[11] Patent Number: 5,017,881

[45] Date of Patent: May 21, 1991

[54] RADIO FREQUENCY ACCELERATING CAVITY HAVING SLOTTED IRISES FOR DAMPING CERTAIN ELECTROMAGNETIC MODES

[75] Inventor: Robert B. Palmer, Shoreham, N.Y.

[73] Assignee: Associated Universities, Inc., Washington, D.C.

[21] Appl. No.: 364,304

[22] Filed: Jun. 12, 1989

[51] Int. Cl.[5] ..... H01J 23/00; H01J 23/20; H01P 1/16

[52] U.S. Cl. ..... 328/233; 333/228; 315/5.16; 315/5.42

[58] Field of Search ..... 328/233; 333/227, 228, 333/230; 315/5.41, 5.42, 5.16, 5.27

[56] References Cited

U.S. PATENT DOCUMENTS

| | | | |
|---|---|---|---|
| 2,593,095 | 4/1952 | Brehm | 178/44 |
| 2,877,434 | 3/1959 | Farr et al. | 333/98 |
| 4,017,760 | 4/1977 | Benoit et al. | 315/39 |
| 4,540,960 | 9/1985 | Giordano | 333/228 |

*Primary Examiner*—Sandra L. O'Shea

*Attorney, Agent, or Firm*—Margaret C. Bogosian; Vale P. Myles

[57] ABSTRACT

An accelerating cavity having one or more iris structures mounted therein for strongly damping unwanted frequencies that are generated in the cavity by bunches of particles in a particle beam that is accelerated through the cavity during its operation. Each of the iris structures is characterized by containing a plurality of radial slots therein that extend from the central aperture through the iris member to the perimeter thereof. The outer end of each of the radial slots includes an enlarged portion that is effective to prevent undesired frequencies from being reflected back into the center aperture of the iris member. Waveguide means connect the outer ends of the radial slots to frequency damping means or to a dump or dumps.

15 Claims, 5 Drawing Sheets

RADIO FREQUENCY ACCELERATING CAVITY HAVING SLOTTED IRISES FOR DAMPING CERTAIN ELECTROMAGNETIC MODES

This invention was made with Government support under contract number DE-AC02-76CH00016, between the U.S. Department of Energy and Associated Universities, Inc. The Government has certain rights in the invention.

BACKGROUND OF THE INVENTION

The present invention relates to a structure and method for strongly damping unwanted or damaging transverse fields in certain higher longitudal electromagnetic modes or frequencies in a radio frequency accelerating cavity.

Such cavities have a number of well-known applications including their use as accelerating devices in particle beam accelerators. As is well known, such accelerators are typically arranged with successive cavities in a linear configuration, or with the successive cavities arranged in a circular configuration. A major objective in designing and building modern particle beam accelerators of either the circular or linear type is to produce a beam of very high luminosity or brightness. The accelerated beam luminosity in a linear collider type of accelerator is known to be severely limited by the total beam power and thus is limited by the efficiency by which radio frequency power is transferred to the beam. Of course, the many other applications of RF accelerating cavities would also benefit from improvements in their RF power transferring efficiency. A primary restricting factor on that efficiency comes from the fields, known as wakefields, that are generated by the particle bunches in an accelerated beam being passed through the series of cavities in a particle beam accelerator structure, such as a linear accelerator or so called linac. Such wakefields act back on the bunches of particles and cause unacceptable momentum spread, distortion or deflection of the bunches.

In a linac that is loaded with many bunches of particles, each bunch is exposed to wakefields that are generated by itself and by a sum of earlier bunches of particles in the beam being accelerated through the cavity. The effects from the fields generated by a given bunch upon itself, at least for shorter particle bunches, are largely determined by the diameter of the beam apertures through the end walls of the accelerating cavity and through any iris structures positioned along the length of the cavity. Besides utilizing the largest possible diameters for such iris(es) and end wall apertures, there is not too much a cavity designer can do about the undesirable effects of the fields themselves, although BNS damping can be used to reduce those undesirable effects. The maximum fraction of RF energy extracted by one bunch of particles is then bounded to a few percent, the exact amount being dependent upon detailed design parameter assumptions. If more efficiency is required in the RF power transfer to the beam, it is necessary to use multiple bunches of particles.

Because the fields that are encountered by a given particle bunch passing through a beamline accelerating cavity are the sum of the fields from the preceeding particle bunches, it is desirable to strongly damp all unwanted and damaging electromagnetic modes in the cavities. The wakefields produced by the plurality of bunches of particles have many different frequencies that are not in general multiples of the bunch spacing and they will not add coherently. Thus for a large number of very small bunches of particles, the contributions of the wakefields are relatively less and higher effiencies of RF power transfer to the beam can be obtained.

Unfortunately in the design of cavities for use in particle beam collider applications, it is necessary to provide both relatively high individual particle bunch loading as well as to provide multiple bunches of particles, in order to obtained the needed high efficiency. In such cases, both momentum spread of the bunches and beam breakup become unacceptable unless the design of conventional accelerating cavities is significantly changed to overcome such problems. The present invention provides an accelerator cavity structure that strongly damps the wakefields generated by each bunch of accelerated particle bunches in a beam passing through the cavity, before succeeding bunches in the beam are introduced into the cavity. Such damping must be accomplished very rapidly; i.e., very low Q's are required to substantially eliminate all unwanted wakefields.

OBJECTS OF THE INVENTION

A primary object of the invention is to provide a radio frequency accelerating cavity structure that strongly damps unwanted or damaging transverse and higher longitudal electromagnetic modes generated in the cavity by bunches of particles that are accelerated through the cavity.

Another object of the invention is to provide an RF accelerating cavity structure that includes one or more irises through which a particle beam is accelerated, and to provide the iris or irises with one or more radial slots that extend from the aperture in the irises to the outer circumference thereof.

Yet another object of the invention is to provide an accelerating cavity having one or more slotted irises in combination with waveguide means that are connected to receive unwanted modes transferred through the slots in the iris to the waveguide, and to transfer those modes to a damping or dump means.

Still another object of the invention is to provide an accelerator cavity having apertured end walls and having a plurality of irises mounted along its length at spaced intervals, with both the end walls and irises being provided with radial slots that extend from the apertures through them to their respective circumferences. In each case, the slots through the irises and end walls are connected to waveguides that feed unwanted frequencies to suitable dumps or damping means.

A further object of the invention is to provide an RF accelerating cavity having radially slotted irises and radially slotted end walls wherein each radial slot is connected to a respective waveguide that is larger in diameter than the slot to which it is connected, thereby to diminish the reflection of undesired modes back into the cavity.

SUMMARY OF THE INVENTION

In a preferred embodiment of the invention a radio frequency resonant cavity for use as an accelerating cavity in a particle beam accelerator arrangement is provided with means for strongly damping unwanted or damaging transverse and higher longitudal electro-magnetic modes that are generated in the cavity by the passage of bunches of particles in a particle beam that is accelerated through the cavity. The damping means includes one or more iris structures mounted in the cavity and provided with radial slots that extend from the iris aperture to the outer circumference thereof. Each of the slots is connected at its radially outer end to a waveguide that is larger in diameter than the slot and that is effective to dump the undesired modes transferred from the radial slots through the waveguide to a suitable damping means or dump that is connected to the other end of the waveguide. In an alternative form of the invention, in addition to the provision of such slotted irises in the cavity, both end walls of the cavity are provided with radial slots that extend from the beam-passing apertures through the end walls to the outer circumferences of the end walls, where each slot is connected to a waveguide of larger diameter. The connecting waveguide transfers the undesired modes that are transferred to it from the radial slot into a suitable damping means or dump. In embodiments of the invention that utilize multiple cell cavities, the radial slots in adjacent irises are arranged so that they do not have the same azimuthal angle. In a most preferred embodiment a cavity for a multi-cell linac utilizes four radial slots per adjacent cell and the succeeding cell slots are arranged to have different azimuthal angles. The outer ends of the slots are associated with waveguides to which the enlarged outer ends of the slots are coupled before exiting the cavity structure, in order to minimize reflection of undesired modes from the waveguide back into the cavity.

BRIEF DESCRIPTION OF THE DRAWINGS

FIG. 2 is a graph that illustrates measured mode frequencies for a cavity such as that shown in FIG. 1, as a function of phase advance per cavity cell.

FIG. 7(*b*) is an end view of the iris shown in FIG. 7(*a*), in combination with a waveguide that is connected to the radially outer ends of the slots through the iris, according to the method of the present invention.

DESCRIPTION OF PREFERRED EMBODIMENTS

Figure 1:
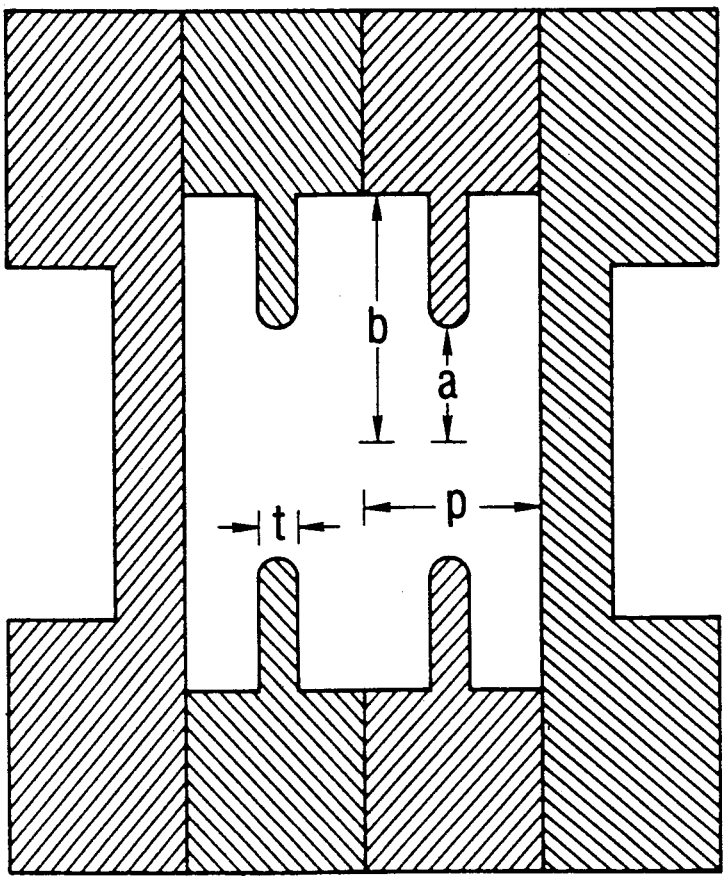
FIG. 1 is a side plan, cross sectional view of an RF resonant cavity of a conventional type that is useful as an accelerating cavity for a high group velocity accelerating structure.

In order to better understand the principles and advantages of the resonance cavity structure of the present invention, a brief description will be given of the studies that were undertaken to develop the preferred embodiments of the invention. Initially, in the studies, a travelling wave structure similar to that utilized in the Stanford University Linear Accelerator (SLAC) was considered, except that for the study there was chosen a relatively larger iris-to-wavelength ratio (i.e. 0.2, instead of 0.1). That selection resulted in a larger group velocity (i.e. 0.07c instead of 0.007c). That choice was made in the initial study in order to reduce the wakefields generated by a single particle bunch accelerated through the cavity. A multi-cell model of the studied structure was construct at one-half the scale of the cavity cell structure used in the SLAC accelerator. FIG. 1 shows a cross section of this cavity structure, and there is shown in Table 1, below, the dimensions corresponding to those designated by letters a, b, p, and t in FIG. 1.

TABLE 1

| Cavity Dimensions |
|---|
| a = 1.0381 cm |
| b = 2.2291 cm |
| p = 1.7526 cm |
| t = 0.2286 cm |

During the early studies for development of the preferred embodiment of the invention, mode frequencies were measured as a function of phase advance for the type of multi-cell cavity structure shown in FIG. 1. There is shown in FIG. 2 of the drawing a number of plotted modes, as respectively labeled at the right border of the Figure, showing the measured frequencies as a function of phase advance. FIGS. 3(*a*), (*b*), (*c*), (*d*) and (*e*) show several examples of these various modes. The deflecting modes illustrated in FIG. 2 are described therein as TE/TM or TM/TE, rather than being simply described as TE or TM. The problem is that such descriptions are only valid in a smooth waveguide. In a loaded waveguide, with phase advance other than 0° or 180°, the modes are always mixed. When described TE/TM, the mode is pure TE at zero (0) phase advance, and TM at 180°. It should be noted that TE/TM mode falls below the TM/TE. This is the opposite of the case with the SLAC type of accelerating cavities, as a consequence of the larger iris aperture selected for study in developing the present invention.

A particle beam passing through a finite section of such a multi-cell accelerating cavity structure will only excite, or be perturbed by, modes with a group velocity equal to that of the accelerated beam. Assuming this to be (c), a straight line can be drawn corresponding to this velocity, as illustrated in FIG. 2. Modes will only be excited where they intercept this line, for example at A, B, C, etc., as shown in FIG. 2. The frequencies and character of each mode are listed below in Table 2.

TABLE 2

| | Frequency (GHz) | List of Synchronous Modes: Phase Advance | Mode | Type | Relative k Loss Factor |
|---|---|---|---|---|---|
| A | 5.63 | 108° | $TM_{01}$ | Accelerated | — |
| B | 7.33 | 144° | $TM_{11}$ | Deflected | 3.5 |
| C | 9.87 | 158° | $TE_{11}$ | Deflected | .13 |
| D | 10.25 | 151° | $TM_{21}$ | Quadrupole | — |
| E | 11.75 | 115° | $TM_{12}$ | Deflected | .52 |
| F | 12.40 | 101° | $TM_{02}$ | Accelerated | — |
| G | 13.00 | 86° | $TE_{12}$ | Deflected | .22 |
| H | 13.40 | 79° | $TM_{12}$ | Sextupole | — |

Current parameter lists of TeV linear collider type accelerators are limited to luminosities in the order of $10^{33}/cm^2/sec$ for a wall power consumption of the order of 100 MW. Such designs employ only single particle bunches and use only from one to a few percent of the stored RF energy in the cavity. If multiple particle bunches can be employed than as much as 25% of the energy can be extracted. However, at the present time, it has been demonstrated that with existing accelerator resonant cavities and the required loading, beam breakup is unacceptable with more than one or two bunches of particles being accelerated by such a cavity. In addition, higher modes of longitudinal wakes will cause unacceptable momentum variations. If, however, the transverse modes could be strongly damped, then the beam breakup would be suitably controlled. If the higher longitudinal modes could also be damped, then the momentum variations will also be suitably controlled. Under such circumstances it should then be possible to extract in the order of 25% of the energy and to obtain working luminosity of over $10^{34}/cm^2/sec$ with the order of 200 MW.

In principle, in designing the type of cavity to be used in the preferred embodiment of the invention, all transverse modes and longitudinal modes other than the first, i.e. all higher modes, should be damped to a negligible value between bunches of particles. This requirement can be eased if the particle bunch spacing is arranged so that it is equal to an integer times a half-wavelength of the most serious modes. If the bunch spacing is "n" cycles of the fundamental, $f_o$ is the frequency of the fundamental and $f_i$ is that of the mode; than this requires that:

$$\frac{f_i}{f_o} = \frac{n}{m},$$

where "m" and "n" are integers. With the cavity that was first considered in studying the structual design for the preferred embodiment of the invention, $f_i/f_o$ was approximately equal to 1.3, so with a slight adjustment of dimensions, the foregoing equation would be satisfied for the first deflecting mode, with "n"=4 and "m"=3; i.e., with one bunch every three cycles.

A study of the transverse wake problem showed that even with this condition, the wakefields for many bunches are still unacceptable. However, the study showed that if the modes were damped, the effects could be controlled, provided condition two is satisfied with some reasonable tolerance; for instance, with a Q of the first transverse mode of 20, then the foregoing equation must be satisfied within an error of about 1%.

A longitudinal wake problem is less severe than that in the transverse direction, because no instability is involved. The wakes from each bunch simply add up and, since they have random phases, they add incoherently. Nevertheless, with the parameters that were considered, they add to give an unacceptable momentum spread between particle bunches. A study of the problem shows that it is controlled if all higher modes are damped with Q's less than about 80, and this was taken as a requirement of the further development studies.

Figure 4A:
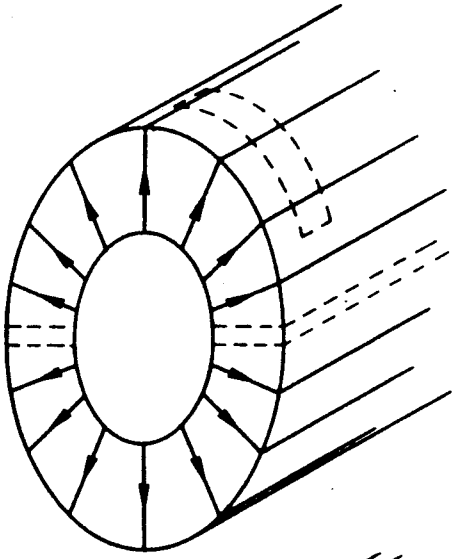
FIGS. 4 (*a*) (*b*) are isometric schematic diagrams that illustrate the approximate directions of current flow in the iris and wall structure of an RF resonance cavity for a particle beam accelerator; (a) illustrates the current flow for the first accelerating mode and (b) illustrates the current flow for the first transverse mode.
Figure 4B:
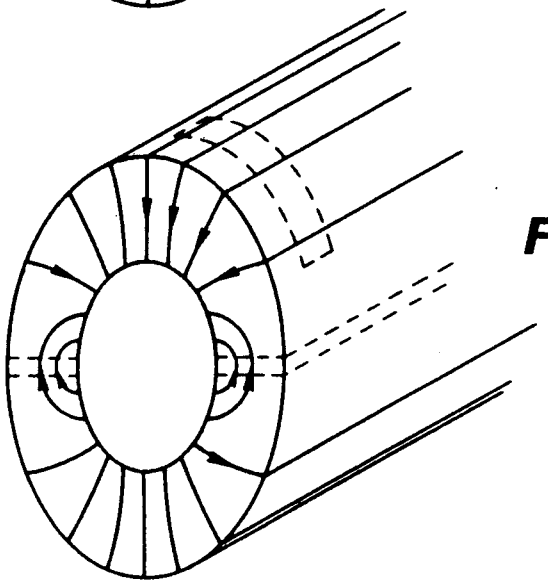

Higher modes could, in principle, be damped by the introduction of resistive materials into the cavity structure, but it would be difficult in this way to damp one and not another mode. Instead it was determined that damping by coupling the unwanted modes into a waveguide, and damping the fields externally, should be evaluated. Such coupling can be accomplished by cutting into the basic cavity with slots leading to waveguides that can be chosen to have a cutoff higher than the fundamental. Thus, such slots will not damp this accelerating mode, but would allow all unwanted higher modes to propagate out of the structure. In placing the cuts to couple fields to a mode in the waveguide, the slots can be placed so as to interrupt current that would normally be flowing in the cavity wall, thereby inducing such currents to enter the waveguide and induce a traveling wave in the guide. FIG. 4(*a*) shows such currents for the fundamental accelerating mode, and FIG. 4(*b*) shows such currents for the first transverse mode. The dotted lines in FIG. 4 indicate two possible locations of such cuts that would interrupt the transverse mode currents. The circumferential type of cut illustrated is seen also to interrupt the current of the accelerating mode, but the "radial cut" is seen to not interrupt such currents, and would therefore not damp the accelerating mode. Because of their relative simplicity, the developmental study first considered use of the circumferential type cuts; then, because of their lack of effect on the accelerating mode, radial cuts were considered. In all cases, the measurements were made in the development studies on a single aluminum cavity cell and only $\zeta$ modes were examined. Also, in the prototypes evaluated, the fields in the waveguides were damped by inserting a cone of resistive plastic foam into the exits of the waveguides. It was found that when this was not done, the Q's of damped modes were, in general, a factor of 2 higher. This was due to the approximately 50% reflection of power from an open-ended waveguide.

Figure 5A:
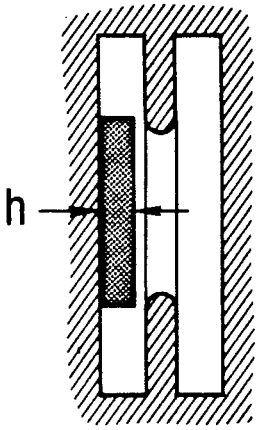
FIG. 5(*a*) is a cross section view along the plane A—A of FIG. 5(*b*) which is a schematic end view of a cavity iris structure in which circumferential slots have been cut.
Figure 5B:
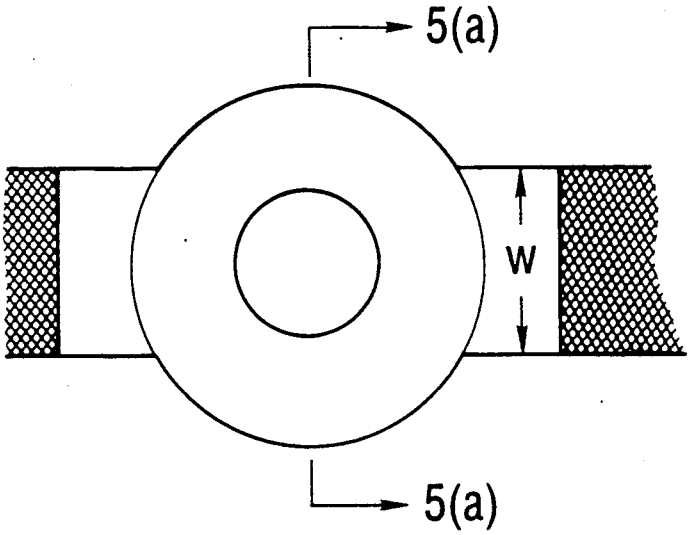
Figure 3A:
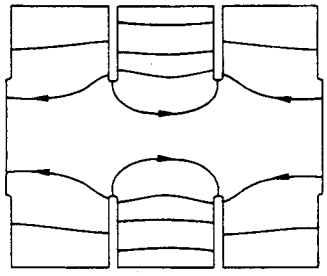
FIGS. 3 (*a*), (*b*), (*c*), (*d*) and (*e*) are schematic side plan views, along a plane through the center of a multi-cell resonant frequency accelerating cavity, wherein electric field lines of a standing wave in the cavity structure are shown for different frequencies or modes generated in the cavity by bunches of particles that are passed through the cavity in an accelerated particle beam.
Figure 3B:
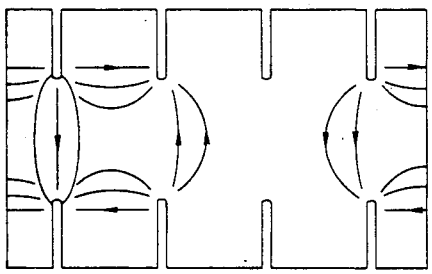
Figure 3C:
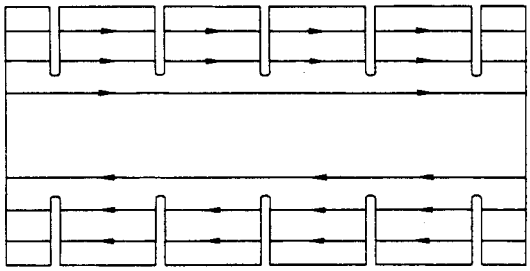
Figure 3D:
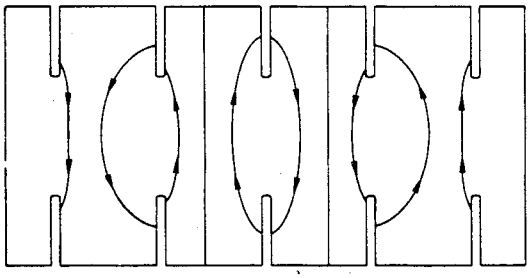
Figure 3E:
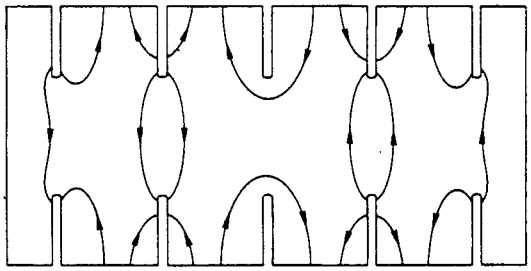

Based upon the studies discussed above, prototype cavities incorporating the characteristic features of the subject invention were constructed. In the iris structure of a resonance cavity, circumferential slots with width (w) and height (h) dimensions were introduced, as shown in FIG. 5. Initially, two dimensions (slots a and b) were tried, as shown in Table 3, below. In the first case, the cut off was chosen to allow damping of all higher modes, including the important first transverse mode. In the second case, the cut off is above this first mode, so that damping could be expected only of the higher modes, in particular of the higher longitudinal modes, the first of which is at a frequency of 11.5 GHz.

The observed Q's for that prototype embodiment are also given in Table 3.

TABLE 3

| Parameters | No Slot | Slot (a) | Slot (b) | Required Q's |
|---|---|---|---|---|
| Observed Q's with Circumferential Slots | | | | |
| (w) Width (mm) | | 23 | 18 | |
| (h) Height (mm) | | 5 | 5 | |
| Cutoff (GHz) | | 6.56 | 8.4 | |
| Acceleration (GHz) | 5.82 | 5.66 | 5.73 | |
| Observed Q's | | | | |
| Acceleration | 966 | 435 | 573 | |
| First Transverse (7.33 GHz) | 548 | 50 | 500 | 20 |
| First Longitudinal (11.5 GHz) | 290 | 20 | 30 | 80 |

In evaluating the circumferentially slotted prototype it was observed that in neither case was the slot in the iris able to lower the Q of the first transverse mode to the required value of 20, but that in both cases the Q of the first longitudinal was well below the required value of 80, as shown in Table 3. Thus, an even wider slot would presumably achieve the required damping of the first transverse mode, but then it would have to have a cutoff below the fundamental and would damp this, too. Even with the cutoff above the fundamental (as in the cases shown in Table 3), a significant reduction in the Q of the fundamental was observed. However, it is important to note that even the initial value was far below that calculated for an ideal cavity. It is believed that the losses came from the relatively high resistance of the metal-to-metal joints used in the prototype cavity, but it can be assumed that the lower Q's observed in the slotted-iris embodiments came from the reduction of the area of those joints. Nevertheless with such slots, some reduction of Q would be expected, even in a brazed cavity structure, due to the longer electrical path for the return currents. It was also noted that as the iris slot was widened, the frequency of the fundamental was perturbed and it can be assumed that this was accompanied by some reduction of the elastance. Thus, it can be seen that there exist several arguments against the use of wide circumferentials slots in the design of such irises for use in an accelerating cavity.

Another developmental study was made of the length of waveguide that will be needed to assure that the fundamental mode Q was not further damped because of fields from that mode extending into the waveguide, even though it was beyond cutoff. The observed Q's in the two cases studied are shown in FIG. 6, together with an extrapolation using the equation:

$$Q_{slot} \propto \frac{2}{E(z)^2} \propto e^{2pz},$$

where $$p = \frac{2\pi}{c}(f_{cutoff}^2 - f_o^2)^{\frac{1}{2}}$$

Figure 6:
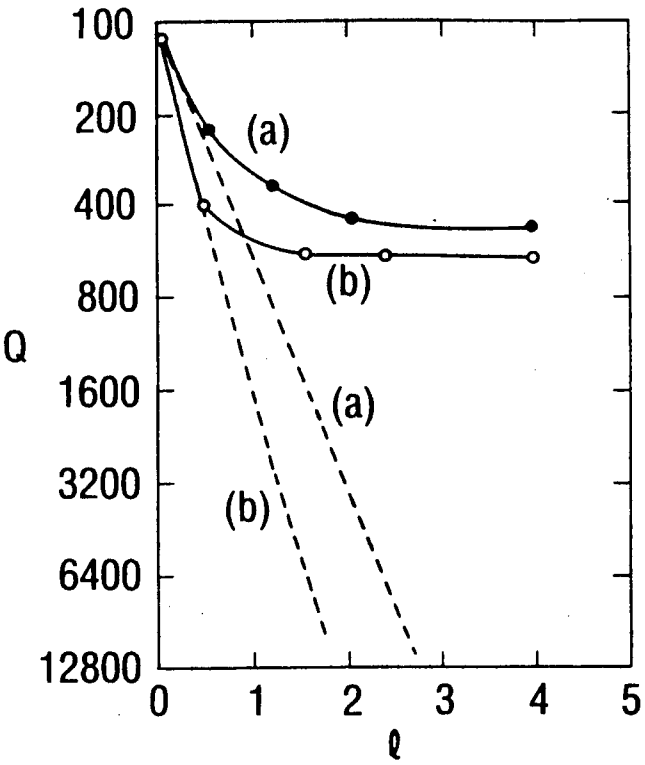
FIG. 6 is a graph that illustrates test results wherein measured Q's for a first accelerating mode are shown as a function of the length of a waveguide to an absorbing plug; curve (a) corresponds to a measured waveguide that was about 23 ×5 mm, and curve (b) shows data obtained for a waveguide that was about 18×5 mm.

From these studies it was concluded that for a brazed copper resonant cavity whose Q would be approximately 10,000 waveguide lengths of 3 cm for the case (a), or 1.6 cm for the case (b), in FIG. 6, would assure negligible further damping.

Because the circumferential slots initially studied, as described above, were found to be unable to afford sufficient damping of the transverse mode, the possible use of a longitudinal slot was also examined. Initially, a slot was tried without a cut through the iris in the cavity but, as is suggested by FIG. 4, this was not effective for the first transverse mode (although it did damp some of the higher modes).

Figure 7A:
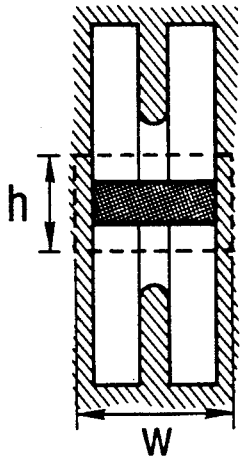
FIGS. 7(*a*) and (*b*) show, respectively, a cross sectional view of a slotted iris for a resonant cavity, with the view being along a vertical axis A—A, as seen in view (b).
Figure 7B:
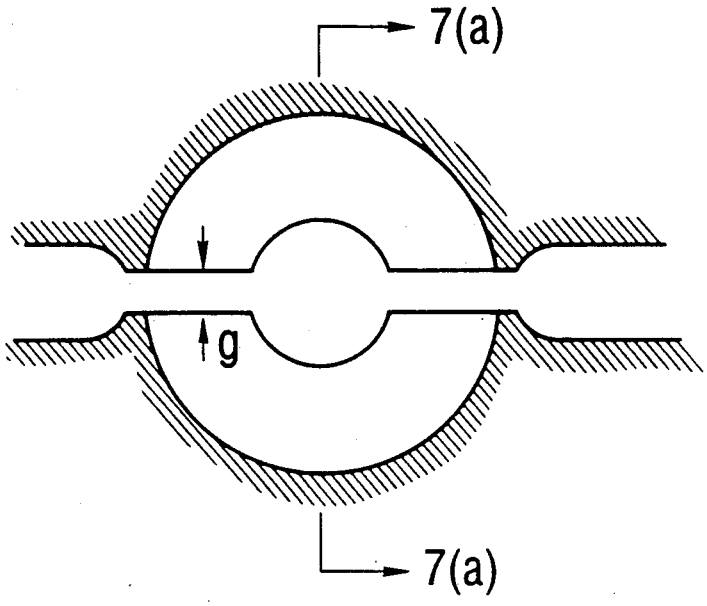

The prototype form of longitudinal slots that were examined with a radially cut iris, is shown in FIG. 7. The length of the prototype slots was chosen to have a cutoff of about 7% above the accelerating mode and was 15% below the first transverse mode. Its length was then 2.4 cm and thus longer than the individual cell length (of 1.75 cm). Although there is nothing inherently wrong with this, it does indicate that if multiple cells are to be used they cannot all have such slots in the same azimuthal angle, as is further explained below.

The width (w, in FIG. 7) of the prototype waveguide studied was 1 cm, but just prior to its entry to the cavity, this was reduced to a slot of 0.5 cm in order to minimize the effect on the accelerating mode. The height (h) of the cut in the iris of the cavity was only 0.27 cm. The object was to minimize the effect on the accelerating mode and, in particular, to minimize the increase in peak electric fields where the iris was cut.

The following three observations were made with this prototype:

(a) a negligible effect on the accelerating mode, in frequency or Q.

(b) a negligible effect on the first higher longitudinal mode.

(c) the apparent disappearance of the first transverse mode.

A study was then undertaken to observe the first transverse mode as the gap width was gradually varied from closed to its full width of 2.7 mm. This study revealed that as the gap was opened, the transverse mode both widens and moves, and that its direction of motion is toward the undamped zero phase advance transverse mode at 8.1 GHz. Estimations of the final Q were then made both by observing the width and by tracking the amplitude of resonance--extrapolating, in the case of the width observation, to the fully open case. Both methods studied were complicated by the presence of the 8.1 GHz signal. Thus, it could only be concluded that the Q of the mode was in the range between 10 and 20, with the width suggesting the higher value and the amplitude the lower value. In either case, it was apparent that the requirement of a Q less than or equal to 20 was achieved.

Figure 8A:
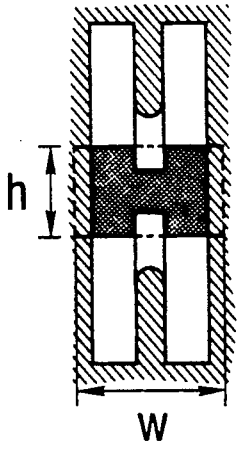
FIGS. 8(*a*) and (*b*) show views of a resonance cavity cell constructed according to the present invention and having a rectangular waveguide entering the cell wall to connect with an enlarge outer end of a slot that extends radially through the iris to its inner diameter.
Figure 8B:
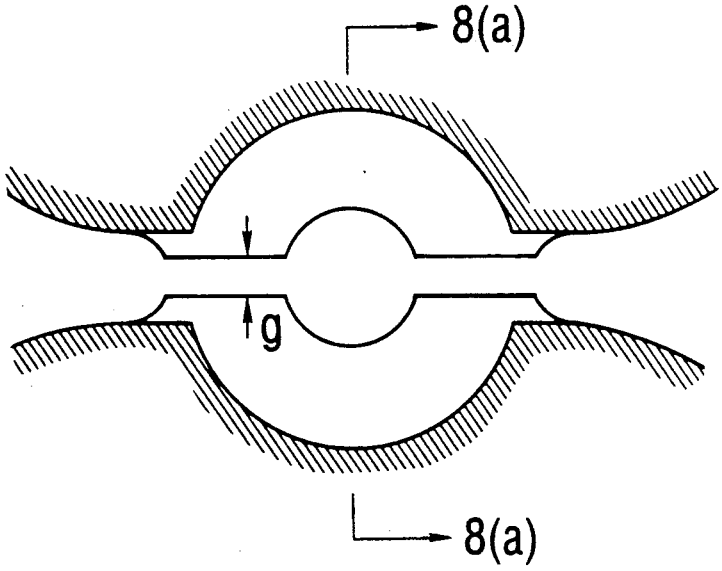

A basically longitudinal slot was then studied, the length and cut iris of which was as described immediately above, but the width of the slot was opened up to 1.4 cm at its enlarged outer end portion, as illustrated by the drawing of it shown in schematic form in FIG. 8(*b*). This width was chosen to have a cutoff in the lateral direction of 10.7 GHz, which is below the first longitudinal mode that was to be damped, although quite a bit narrower than even the smaller circumferential slots described above. As expected, the first transverse mode was again damped to a Q of between 10 and 20. The first longitudinal mode was observed to have a Q of 80. It should be noted that in a linac, a designer would wish to damp both horizontal and vertical transverse modes, and it should be understood that there will thus have to be twice as many slots as were used in the prototypes tested. As a result, the longitudinal damping will be twice as strong; i.e., a Q of 40 would be expected where 80 is required, which is certainly acceptable. The Q of the acceleration mode was lower by 20% which, with double the number of slots, would become 40% but because of the bolted nature of the prototype cavity tested, this was presumed to be an over-estimate. A preliminary study with a three-dimensional computer code (name "MAFIA") indicated a loss of only about 2%.

Thus, it appears that a suitable design solution for the preferred embodiment of the invention requires damping of both the first transverse and longitudinal modes. An examination of higher modes suggested that they also meet the design requirement for the preferred embodiment of the invention.

Figure 9A:
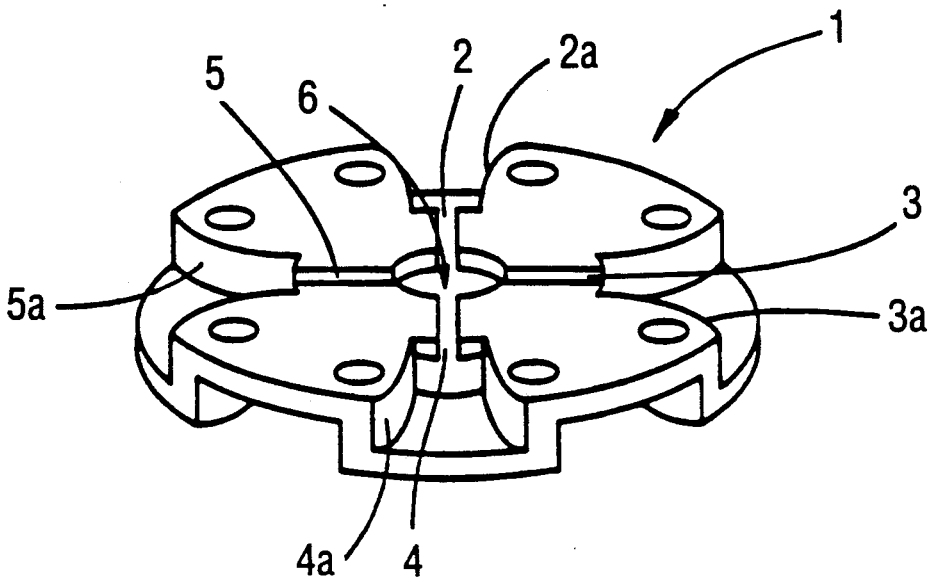
FIG. 9(*a*) illustrates a single resonance cavity iris cell constructed according to a preferred embodiment of the invention, and FIG. 9(*b*) illustrates a multi-cell, stacked iris structure assembly in which each cell contains four radially extending slots that are enlarged at their outer ends to prevent the reflection of undesired modes back into the beamline-transporting aperture through the irises.
Figure 9B:
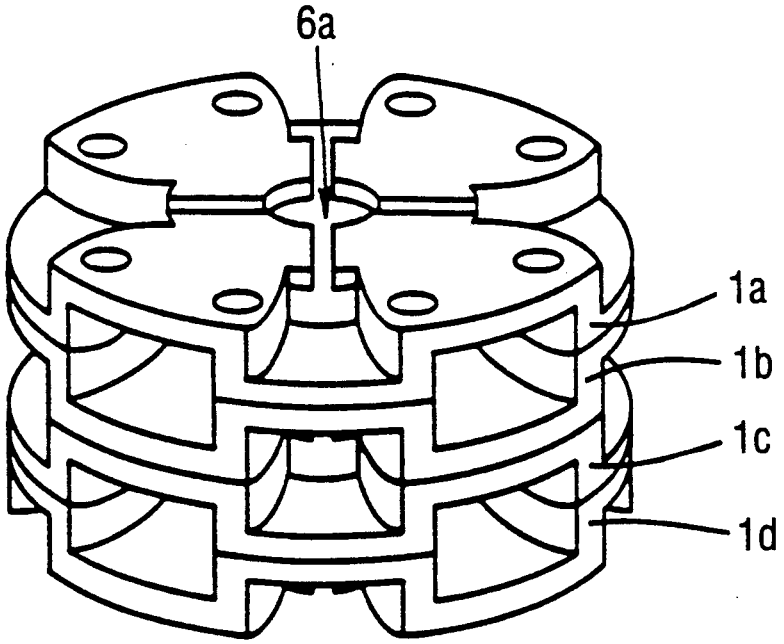

Utilizing the test results on the prototypes described above preferred embodiments of the damped accelerating cavity structures of the present invention were manufactured. FIG. 9(*a*) of the drawing illustrates an iris structure 1 for such an accelerating cavity, constructed according to the invention. The iris member 1 may be constructed of any suitable electrically conductive metal and includes wall means that define a plurality of radial slots 2, 3, 4 and 5 therein. The wall means further define in the iris, at the respective outer ends of each of the radial slots an enlarged portion that is generally horn or cone shaped such as the illustrated enlarged portions 2*a*, 3*a*, 4*a*, and 5*a* shown in FIG. 9(*a*). When the iris is mounted in an accelerating cavity, these enlarged outer portions of the radial slots serve to prevent unwanted modes from being reflected back into the central aperture 6, of predetermined diameter, that is formed through the iris 1. As can be seen in FIG. 9*a*, in this preferred embodiment the radial slots 2–5 are arranged to be spaced essentially ninety azimuthal degrees from one another. Although the walls of a resonant cavity are not illustrated in FIG. 9, it will be understood that the iris 1 may be mounted in the type of cavity shown in FIG. 1, in lieu of the unslotted iris cells shown in FIG. 1.

In FIG. 9(*b*) there is shown a stacked assembly of damping iris structures, like the one shown in FIG. 9(*a*). Thus, in FIG. 9(*b*) there are four such stacked iris members 1*a*, 1*b*, 1*c*, and 1*d* arranged as shown. Each of the iris members is identical to that illustrated in FIG. 9(*a*), and each has four radial slots per cell. As required in this embodiment, and according to the invention, succeeding cell radial slots are arranged so that the radial slots in the next adjacent iris member cannot be the same azimuthal angle as the slots in its neighboring iris members. As is the case with the individual iris member 1, shown in FIG. 9(*a*), in the stacked assembly of FIG. 9(*b*) each of the enlarged outer end portions of the respective radial slots serves to minimize the reflection of unwanted modes back into the center aperture 6*a* of the stacked iris assembly. It should be understood that the entire stacked iris assembly is supported inside a larger vacuum chamber which may be of a conventional accelerating cavity design (e.g. such as the type of chamber shown in FIG. 1), and which may have a desired number of RF damping resistors or which may be made of relatively high resistance material. Because the stacked iris damping assembly is supported within such a vacuum container, water cooling would need to be provided integral to the structure in a suitable conventional manner. Such an accelerating cavity design has the advantage of providing very good vacuum pumping to the inside of the cavities and such pumping is facilitated by the slotted radial irises of the invention.

In an alternative embodiment of the invention, the first and second end walls of the resonant cavity include wall means that define radial slots, such as the slots 2–5 shown in the iris of FIG. 9(*a*), and further define a central aperture for passing a beam of particles through the cavity. The radial slots in the end walls each extend from the central aperture through the wall to its outer circumference, and waveguides are operatively connected to the outer ends of each of the slots to transfer unwanted electro-magnetic modes from the slots into a frequency damping means or into a suitable dump that is disposed in communication with the waveguide. Because the radially slotted structure of such cavity end walls can be formed essentially like the slotted irises illustrated in FIGS. 9(*a*) and (*b*), they are not separately shown herein. It should be understood that if such radially slotted end walls are used in combination with one or more irises, such as those shown in FIG. 9, the apertures in the end walls would be aligned with the apertures through the centers of the iris(es). Also, the iris(es) should be arranged so that their major planes are in orthogonal relationship to the aligned axis through the central apertures.

Rather than describe in detail herein the more conventional features of such a suitable accelerating cavity, reference is made to the teaching of U.S. Pat. No. 4,540,960, which illustrates a radio frequency resonance cavity that includes various mode damping means and, in particular, illustrates a double-wall cylindrical cavity having frequency damping material disposed between the walls, as shown in FIG. 2 of that patent. It should be understood that the stacked damping iris assembly shown in FIG. 9(*b*) may be suitably mounted within the types of accelerating cavities shown in that U.S. Pat. No. 4,540,960; accordingly, the disclosure of that patent is incorporated herein by reference. For example, if the stacked damping iris assembly shown in FIG. 9(*b*) were to be properly supported in the accelerating cavity shown in FIG. 2 of that referenced patent, the respective radial slots 2–5 in the iris members 1*a*–1*d* could either be placed immediately adjacent to the inner cylindrical wall (7), shown in FIG. 2 of that patent, or could be connected, as described above herein, by suitable waveguide means to the frequency damping material (9) illustrated in that patent as being supported between the inner cylindrical wall (7) and the outer cylindrical wall (6) of the cavity.

It will be apparent to those skilled in the art that various further modifications and improvements of the invention may be made from the teaching presented herein. Accordingly, it is my intention to encompass the true limits of the invention within the following claims.

I claim:

1. A resonance cavity structure for strongly damping undesirable transverse and higher longitudinal electromagnetic modes that are generated in an associated resonance cavity when it is used as a particle beam accelerating cavity, comprising, at least one iris formed of electrically conductive material and having an aperture of predetermined diameter through its center, wall means in said iris defining a plurality of radial slots that extend, respectively, from said aperture to the outer circumference of the iris, and a plurality of wave guides each operatively connected, respectively, to the outer end of a different one of said slots thereby to transfer unwanted modes from said slots to a damping means or dump disposed in communication with the outer ends of the wave guides.

2. A cavity structure as defined in claim 1 wherein a plurality of said irises are positioned in stacked relationship within a resonance cavity, and wherein a separate wave guide is operatively connected between the respective outer end of each radial slot in each iris, thereby to transfer unwanted modes from each of said slots to a damping means or dump disposed in communication with the outer ends of the wave guides.

3. A cavity structure as defined in claim 2 wherein said wall means in each iris further defines an enlarged outer end portion of each radial slot, said enlarged outer end portions being operative to inhibit the reflection of unwanted modes from the outer ends of the slots into the center aperture of the associated iris.

4. A cavity structure as defined in claim 3 wherein the stacked irises are arranged to prevent their respective radial slots from being at the same azimuthal angle as the radial slots in the next adjacent iris or irises.

5. A cavity structure as defined in claim 4 wherein each stacked iris is arranged with respect to its next adjacent iris or irises so that the radial slots in said adjacent irises are about 45 azimuthal degrees from one another.

6. A cavity structure as defined in claim 3 wherein the enlarged outer end portion of each of said radial slots is about 1 cm in width and the inner end of each of said slots is about 0.5 cm in width.

7. A cavity structure as defined in claim 2 wherein the length of each radial slot is selected to make it have a cutoff about 7% above the accelerating mode of the associated cavity and about 15% below the first transverse mode of the cavity.

8. A cavity structure as defined in claim 5 wherein each of said irises includes at least 4 of said radial slots, and each of said slots in a given iris are approximately 90 azimuthal degrees from one another.

9. A radio frequency resonance cavity comprising a generally cylindrical wall and first and second end walls, said end walls each including an aperture at its center for passing a beam of particles through the cavity, wall means defining a plurality of radial slots in each of said end walls, said slots each extending from the aperture through the wall to its outer circumference, and waveguides operatively connected to each of the slots to transfer unwanted electro-magnetic modes from said slots to a frequency damping means or dump disposed in communication with the waveguides.

10. A cavity as defined in claim 9 including at least one iris formed of electrically conductive material and having an aperture through its center, said iris being positioned within the cavity so that the aperture through the iris is in alignment with the apertures through the end walls of the cavity and so that the major plane of the iris is in orthogonal relationship to the aligned axis of said apertures, wall means defining a plurality of radial slots each of which extend from the aperture in the iris to its outer circumference, and a plurality of waveguides each operatively connected, respectively, to the outer end of a different one of said radial slots thereby to transfer unwanted modes from the slots through the waveguides to an associated damping means or dump.

11. A cavity as defined in claim 10 wherein a plurality of such irises are mounted in stacked relationship within said cavity and are similarly connected to associated waveguides.

12. A cavity as defined in claim 11 wherein each of said irises includes wall means that respectively define enlarged outer end portions of each of said radial slots, each of said enlarged outer end portions being effective to inhibit the reflection of unwanted modes from the outer end portions back into the cavity.

13. A cavity as defined in claim 12 wherein each of said irises within the cavity are arranged to position the radial slots in immediately adjacent irises about 45 azimuthal degrees from one another.

14. A cavity as defined in claim 12 including a body of frequency damping material positioned in the outer end portion of at least some of said waveguides.

15. A cavity as defined in claim 12 wherein each of said enlarged outer end portions is about twice the width of the inner end of the radial slot.

* * * * *